United States Patent [19]

Hergenrother et al.

[11] 4,177,400

[45] Dec. 4, 1979

[54] PROJECTION CATHODE RAY TUBE HAVING TARGET ANGULARLY AND LONGITUDINALLY ADJUSTABLE TO TUBE AXIS

[75] Inventors: George R. Hergenrother, Waltham; Peter J. Sprague, Lenox, both of Mass.

[73] Assignee: Advent Corporation, Cambridge, Mass.

[21] Appl. No.: 890,321

[22] Filed: Mar. 27, 1978

[51] Int. Cl.[2] ..... H01J 31/00; H01J 29/24

[52] U.S. Cl. ..... 313/477 R; 313/478; 358/239

[58] Field of Search ..... 313/459, 461, 482, 148

[56] References Cited

U.S. PATENT DOCUMENTS

| | | | |
|---|---|---|---|
| 2,435,316 | 2/1948 | Larson | 313/148 X |
| 2,453,003 | 11/1948 | Edwards | 358/239 |
| 2,663,012 | 12/1953 | Beers | 313/465 X |
| 3,157,055 | 11/1964 | Medicus et al. | 313/148 X |
| 3,794,874 | 2/1974 | Mulder et al. | 313/148 X |
| 3,969,648 | 7/1976 | Hergenrother et al. | 358/239 X |

FOREIGN PATENT DOCUMENTS

| | | | |
|---|---|---|---|
| Ad.60011 | 9/1954 | France | 313/148 |

*Primary Examiner*—Robert Segal

*Attorney, Agent, or Firm*—Kenway & Jenney

[57] ABSTRACT

A projection cathode ray tube has a target that is mechanically adjustable by means external to the evacuated envelope. The target extends into the evacuated space and is mounted upon a bellows that forms part of the envelope. The target is moved relative to other optical elements within the envelope by means extending through the bellows to provide both axial and pivotal adjustment after the tube is sealed. This structure enables other optical components including image reflectors to be constructed integrally with the envelope, and also improves heat transfer between the target and the external space, permitting control of the target temperature.

10 Claims, 3 Drawing Figures

PROJECTION CATHODE RAY TUBE HAVING TARGET ANGULARLY AND LONGITUDINALLY ADJUSTABLE TO TUBE AXIS

BRIEF SUMMARY OF THE INVENTION

This invention relates generally to projection cathode ray tubes. These tubes include forms that employ a variety of optical configurations adapted for projection of electronically generated images into viewing screens external to the tubes. More particularly, the invention relates to tube structures incorporating a target within the tube envelope, the target having a surface coated with an electron beam sensitive coating. Such coatings generally comprise either phosphors or dark trace materials, depending upon the particular system employed. An electron gun is situated in position to project an electron beam upon the target in a cursive pattern or raster. The beam either generates a visible light image by fluorescence upon the target surface or modulates a beam of visible light impinging on the target to form a visible image, this image in either case being projected from the tube through suitable optics to an external screen.

A principal object of the invention is to improve the structure of the projection cathode ray tube particularly with regard to the means for mounting and adjustment of the target relative to the other tube components. Typically, due to the magnification of the image, this adjustment is of critical importance. In the structures hitherto employed a variety of problems have arisen in this respect. These are illustrated by a number of patents disclosing Schmidt optics in projection television tubes. Such patents include those to Edwards U.S. Pat. Nos. 2,453,003, Amdursky 2,520,190, Harries 2,960,615, Beers 2,663,012 and Sheldrake et al 4,034,398. The principal elements in the tubes are an electron gun, a target coated with a phosphor upon a surface directly facing the impinging electron beam, a concave mirror having a central aperture through which the electron beam passes, the mirror comprising a portion of a spherical surface, and a transparent face plate through which the image is projected upon a screen external to the envelope. In all of these systems a correction lens is located between the mirror and the screen for optical correction including correction for spherical aberration produced by the mirror. The correction lens may be located externally of the tube envelope in front of the tube face plate, or incorporated in the tube envelope as the face plate, or located inside the tube envelope between the target and the face plate.

In the structures of each of the above patents the location of the target in relation to the mirror is critically important. To provide a means of adjustment, the target and the mirror are both mounted for relative adjustment on a frame structure totally enclosed within the tube envelope. The means of adjustment typically comprise threaded members on the frame that are accessible for adjustment only during initial subassembly, prior to the sealing and evacuation of the tube. Typically, a test bench is arranged to support the frame with the target and mirror assembled thereon, a light source and a viewing screen. The adjustments take into account the optical requirements of the completed television projection system which may comprise either a single projection tube or multiple tubes, as in the three-color separation tube system described in the patent to Harries U.S. Pat. No. 3,004,099. Because of the magnification of the image, even very small movements of the target in relation to the mirror result in large changes in either the axial focus or in the focal plane tilt, or both. The acceptability of errors or shifts in adjustment in any particular projection system is dependent on its resolution requirements and on the ability to compensate by altering the viewing screen placement. Also, a small error that may be acceptable in a single tube display may not be acceptable in a multiple tube system where the images must be in registration on the viewing screen.

The systems described above, which employ a metal framework joining the mirror and target as a preadjusted assembly, are both costly and elaborate. Moreover, assuming that all settings are precisely made on the test bench, the assembly may undergo subsequent stresses of sufficient magnitude to produce noticeable and even prohibitive shifts in the optical alignment, which cannot be corrected after the tube has been fully constructed. First, in the sealing and bake-out operations of cathode ray tube manufacture, the parts are subjected to large temperature extremes, which may cause permanent changes in alignment, particularly as a result of differences in the thermal expansion coefficients of the several parts which are constructed of different materials. Second, the finished tubes may undergo mechanical shock ad vibration during shipping and handling, causing a permanent misalignment. Third, in use a substantial quantity of heat is generated by the small, brightly lit target surface. This heat may do damage in various ways if not efficiently dissipated. For example, when the projection tube is turned on and off, the stresses of expansion and contraction of the target assembly due to heat may loosen the locked adjustments and cause a permanent focus misadjustment.

Thus the systems described above are subject to the possibility of permanent misadjustment that cannot be corrected because of the inaccessibility of the means of adjustment once the cathode ray tube is sealed. Moreover, these systems have encountered further difficulties that result from mounting the target upon a framework that is in turn supported within the tube envelope. Such a structure often has a limited capability for dissipation of heat from the target surface to the region surrounding the projection tube. As heat accumulates it limits phosphor efficiency and life. Also, as the parts reach higher temperatures they further expand, causing a temporary optical focus drift during operation. The inaccessibility of the means of adjustment prevents compensation for such temporary drifts during operation of the tube.

With a view to overcoming the above-mentioned difficulties, this invention features a novel construction of the cathode ray tube envelope that incorporates a bellows sealed in an aperture in the face plate. The bellows, as shown, extends inwardly of the envelope and its inner end is closed, the target member being secured within the envelope to this inner end. Alternatively, if desired, the bellows can be arranged to extend outwardly of the envelope from the end which is sealed to the face plate. In this case the outer end of the bellows is closed. Thus in either case the interior of the bellows is external to the evacuated space. For adjustment which may be accomplished at any time after completion of the tube construction, a stem or shaft is attached to the target member and extends through the interior of the bellows to an external device, typically a frame adapted for positional adjustment of the shaft. The means of adjustment are adapted to effect any of the various modes of positional adjustment of the target that the bellows can inherently accommodate. These modes include both translation along the axis of the projection tube and rotation or tilt about any axis transverse to the tube axis.

Another feature of this invention is that it provides a direct path for metallic conduction of heat from the target member to the external space, through both the mechanical adjustment structure and the bellows itself. Thus the heat developed on the target surface is readily dissipated and controlled. In addition, the assembly provides a means for applying heat to the target from a source external to the envelope, if desired.

Other features of the invention comprise details of structure and arrangements of the parts that will become evident from the following description of a preferred embodiment.

DETAILED DESCRIPTION

Figure 1:
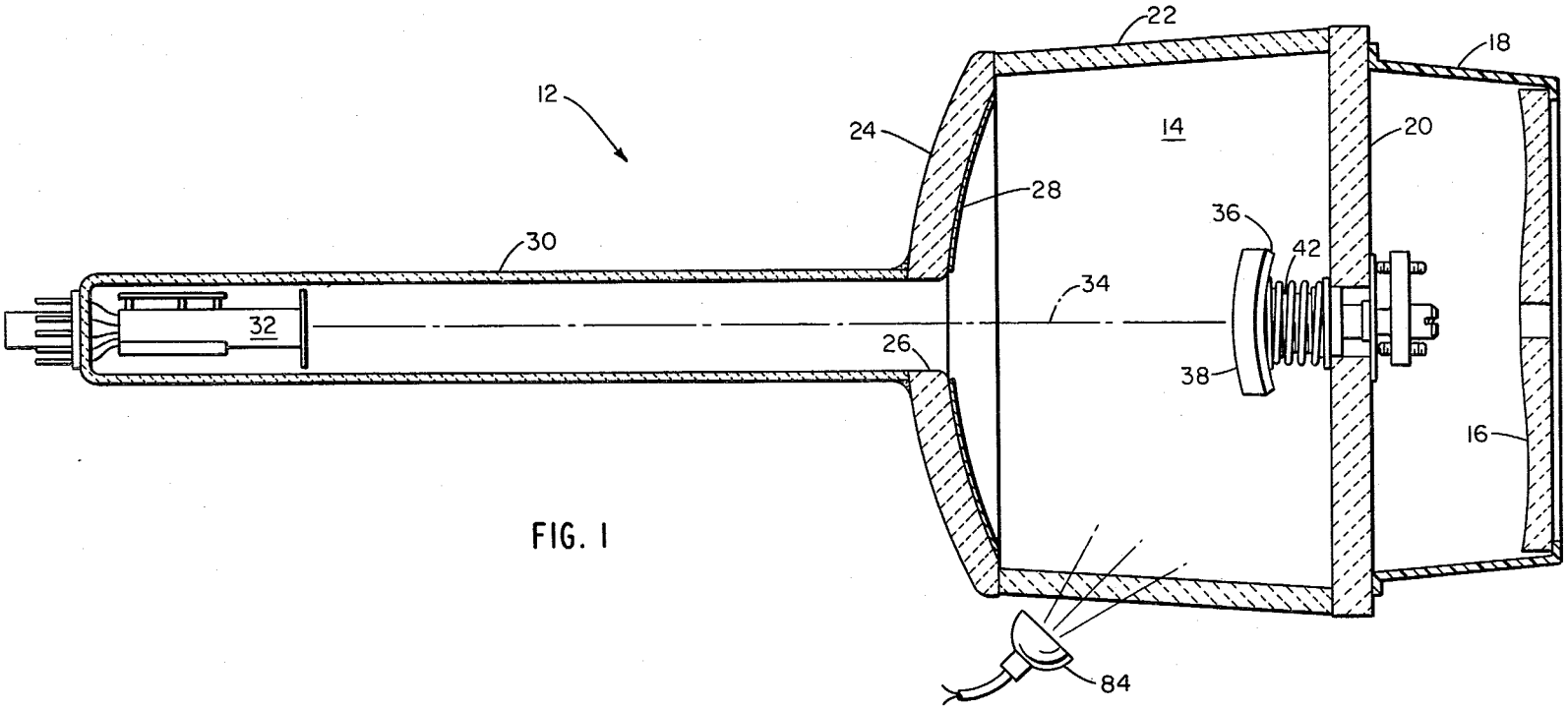
FIG. 1 is a longitudinal elevation in section of a projection cathode ray tube embodying a preferred form of the invention for application to a Schmidt optical embodiment.

FIG. 1 illustrates a preferred embodiment of the invention as incorporated in a Schmidt optical projection system within a projection cathode ray tube 12. The tube comprises a number of portions forming a sealed envelope enclosing an evacuated space 14. A correction lens 16 is mounted upon a generally tubular shroud 18 which is attached to a flat glass face plate 20 on the tube envelope. The other portions of the envelope preferably comprise a plurality of glass or ceramic parts suitably sealed together in a conventional manner. A tubular portion 22 is preferably either cylindrical or truncated conical in shape. A mirror portion 24 is disk-shaped and is shown with a central aperture 26. In some embodiments this aperture may be offset to some extent. A metallic reflective coating such as aluminum is evaporated or otherwise deposited to form a concave interior mirror surface 28 on this portion, the mirror conforming substantially to a part of the surface of a sphere. An electron gun container portion or neck 30 is of elongated tubular shape and closed at its end opposite the aperture 26. An electron gun 32 of conventional construction is housed within and adjacent the closed end of the portion 30, and arranged to project an electron beam along an axis of symmetry 34 through the tube neck, hereinafter called the tube neck axis. The projection tube is also provided with either electrostatic or magnetic electron beam lens elements and deflection means to trace an image, all of which are conventional. For this purpose the tubular portion 30 is preferably elongated with the lens and deflection elements surrounding it.

A target member 36 is mounted within the projection tube in position to permit the electron beam to impinge directly upon a target surface 38 that typically conforms substantially to a part of the surface of a sphere, the surface 38 being approximately the same size as the standard television raster traced by the electron beam. Typically, the surface 38 is generally a barrel-distorted rectangle as viewed axially from the left in FIG. 1, and covered by an electron beam sensitive coating 40. By the term, "electron beam sensitive coating" is meant both a phosphor or other fluorescent material of the general type commonly used in direct viewing television tubes, and also dark trace materials such as those described in the above-mentioned patent to Beers, for example. Thus it is intended to include both materials that generate visible light during or after the impingement of an electron beam thereon, as well as materials that vary in reflectivity or opacity to impinging visible light in response to variations in the intensity of a beam of electrons that also impinge on the surface.

Figure 2:
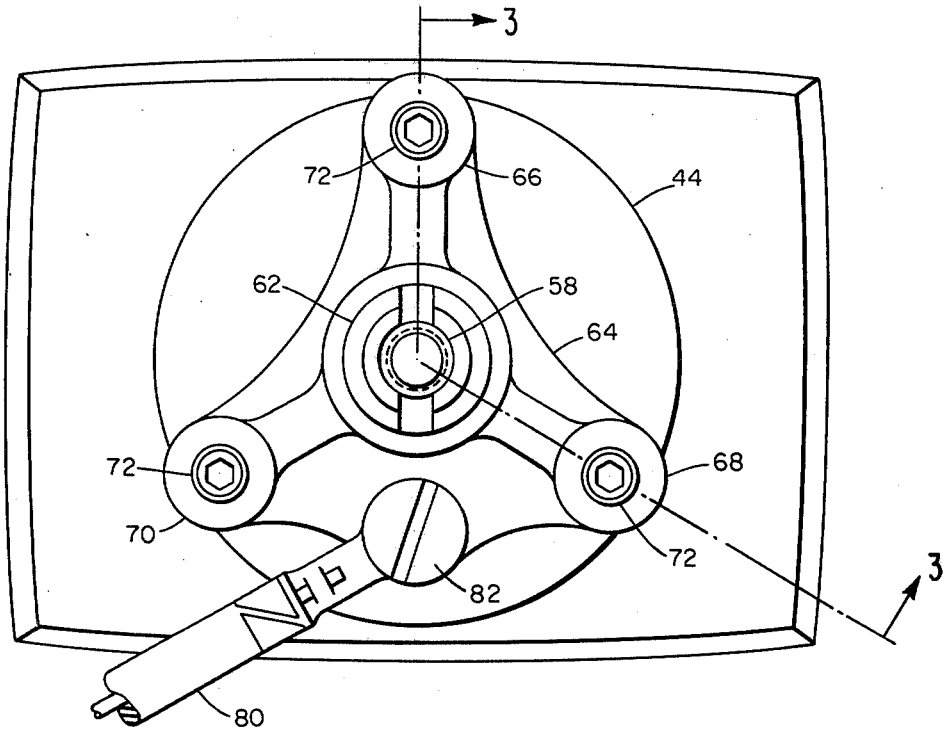
FIG. 2 is a front view from the right in FIG. 1 with the correction lens removed.
Figure 3:
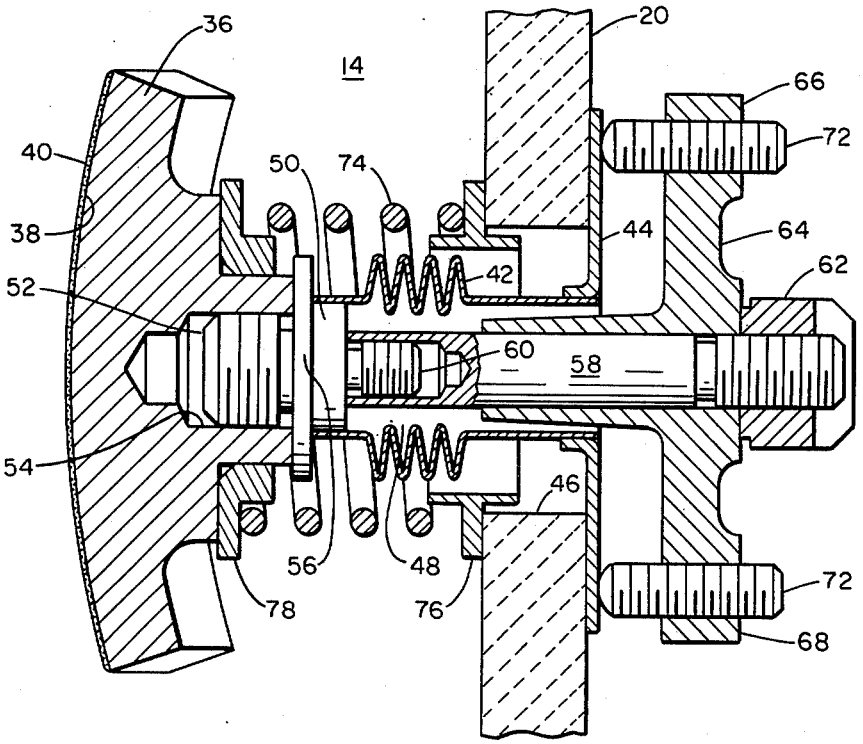
FIG. 3 is an elevation in section taken on line 3—3 of FIG. 2.

Means are provided to adjust the target member position relative to the mirror surface 28, as shown in detail in FIGS. 2 and 3. To accommodate these means, the envelope includes a metallic bellows 42 having a closed end and an open end, and a circular metal flange plate 44 welded and sealed about the open end. The plate 44 is also sealed to the face plate 20, thereby covering and sealing a central aperture 46 in the latter. Thus the interior space 48 of the bellows is at atmospheric pressure and the exterior of the bellows is situated within the evacuated space 14. Preferably, the bellows is closed by welding it with a pressure seal to a flanged spindle member 50 having a stud 52 threaded into a blind hole 54 on the back of the target member 36. A flange 56 integral with the spindle member 50 firmly abuts a shoulder on the member 36, so that the latter moves in response to any movement of the closed end of the bellows.

A shaft 58 has internal threads at one end to receive a threaded stud 60 integral with the spindle member 50, and the opposite end of the shaft 58 has external threads received within an adjusting drive nut 62.

A three-legged metal frame 64 has a central bore for slidably receiving the shaft 58, and three integral bosses 66, 68 and 70 in 120-degree angularly spaced relationship. Each of the bosses is threaded to receive an adjusting screw 72, each screw being formed at one end to receive a wrench and at the other end to bear upon the plate 44.

Surrounding the bellows 42 is a helical compression spring 74 bearing at one end on a tubular flanged seating ring 76 received over the aperture 46, and at the other end on a flanged ring 78 bearing against an annular surface of the target member 36. In the completed assembly the spring 74 is under compression, thereby transmitting tensile stress through the shaft 58 and causing the screws 72 to bear with pressure upon the plate 44. If desired, the bellows 42 may be constructed of a metal so formed as to have an appreciable spring rate, whereby it is also under compression in the final assembly, thus acting in the same direction as the spring 74. In some cases it may be sufficient to eliminate the spring 74, in which case the bellows 42 provides sufficient tensile stress in the shaft 58 to ensure that the screws 72 will bear with sufficient pressure upon the plate 44 under all conditions. It will also be apparent that instead of having the spring 74 external to the bellows 42, it may be mounted internally of the bellows within the space 48 by a suitable modification of the dimensions and arrangements of the parts.

In fabrication, a sub-assembly is formed to comprise the bellows 42 welded and pressure sealed to the plate 44 and the spindle member 50. The plate 44 is then placed over the aperture 46 in the face plate 20 and pressure sealed to the latter. Then, the spring 74 with the rings 76 and 78 are placed over the bellows and the target member 36 is threaded on the stud 52 until it tightly abuts the flange 56. Then, the shaft 58 is inserted through the bellows, and threaded on the stud 60 until rigidly secured to the spindle member 50. Finally, the other portions of the tube envelope are assembled together, sealed and baked out in accordance with conventional practice.

In operation, the position of the target surface 38 is mechanically adjusted with direct reference to the outer surface of the plate 44, which is in rigid relationship to the mirror 28, the latter being an integral part of the rigid tube envelope. Adjustments of the target longitudinally of the tube axis 34 are accomplished by rotation of the adjusting drive nut 62. These adjustments change the focus of the projection tube. A similar movement can be accomplished alternatively or in combination with such adjustment by equal rotations of the three screws 72.

Also, the axis of the shaft 58 may be rotated about any desired axis transverse to the tube neck axis 34 by selective differential rotations of one or more of the screws 72. Although approximate adjustments may be made during manufacture prior to completion and evacuation of the tube envelope, final and precise adjustments are made after completion of the tube construction. This permits the precise adjustment of the parts to be accomplished under actual operating conditions with an electron beam impinging on the target surface 38.

As shown in FIG. 2, a lead 80 is connected by a screw 82 to the frame 64. This provides an anode connection to the target surface 38.

It will be noted that the assembly as illustrated in FIG. 3 is retained in adjusted position by reason of the compression in either the spring 74 or the bellows 42 or both, assisted by a pressure differential that exists between the exterior and the evacuated interior of the bellows. If desired, means may be provided to lock the screws in proper adjustment. For example, lock nuts may be threaded on to the adjusting screws 72 and against the bosses 66 once the adjustments have been completed. A lock nut may be similarly threaded upon the outwardly projecting end of the shaft 58.

If desired, means may be added to the above-described structure to clamp the respective adjusting screws 72 to the plate 44 in a rigid manner once the desired adjustments have been completed. This may be done by means of suitable brackets, springs, clamps or rigidly setting adhesive or potting compounds. This will retain the shaft 58 and the attached target member in rigid relationship to the face plate 20 without any further necessity for retaining tensile stress on the shaft 58.

As shown particularly in FIG. 3, a direct path for metallic conduction of heat to or from the target member 36 is provided through the spindle member 50, the shaft 58 and the adjusting frame 64, as well as the bellows 42 and the plate 44. The frame 64 has a large area interface with the air external to the tube envelope. This provides not only a means for rapidly dissipating heat generated on the target surface 38, but also a means for adjusting the rate of heat dissipation, thus making it possible to control the temperature of the target member 36 within prescribed limits. Control of this temperature is most important because the sensitivity of the coating on the surface 40 to the electron beam is often a function of its temperature. Such control may be accomplished in a number of ways, as by attaching or incorporating heaters or heat sinks to or with the frame 64. Actually, the frame 64 itself comprises a heat sink. Such heat sinks may be adjustable by well known techniques according to or as a function of the desired temperature of the member 36. Heat may be added to the above mentioned structure by means of an external heating device attached to any of the parts 42, 44, 50, 58, 62 or 64. This device, coupled with means for regulating it, is particularly useful in dark trace applications where the sensitive coating 40 may have improved characteristics between certain temperature limits.

Although the face plate 20 as shown in the illustrated embodiment is a flat glass plate, with optical corrections as required in a Schmidt projection system being provided by a separate correction lens 16 external to the tube envelope, the face plate itself may be formed as the correction lens. In this case the entire optical system is incorporated within the tube envelope.

Fabrication of projection tubes in accordance with this invention is substantially simplified in comparison with prior art structures. This results in part from the reduction in the number of parts. The reduction in the surface area exposed to vacuum improves the cleanliness of the tube. The necessity for maintaining high tolerances in the relationship between the mirror and target, especially through high temperature tube frit and bake-out cycles, is reduced. Thus manufacturing tolerances of parts holding the target in relation to the mirror may be comparatively relaxed. In addition, since the target structure is supported by the face plate 20, the invention eliminates the necessity of providing other forms of support, such as brackets or spiders extending radially of the target across the face plate 20, where they partially block the light rays reflected from the mirror 28.

The invention thus provides a means for readily changing the focal length of a fully assembled projection cathode ray tube, this being a function of the position of the target surface longitudinally of the optical axis. The optical axis is a line passing through a radius of curvature of the mirror surface 28 and lies in the axis about which the correction lens 16 has been generated in accordance with well-known optical principles.

As noted above, the electron beam sensitive coating 40 may comprise either a phosphor or a dark trace material. In the latter case, means are provided to direct a beam of light upon the target surface. Such means are illustrated in FIG. 1 by a lamp 84. For this purpose the tubular portion 22 of the envelope may be constructed of clear glass. If desired, the portion 22 may be made of glass or ceramic and may be formed with an aperture and a lateral extension from the aperture to house a lamp directed at the target face. Alternatively, the light beam may be directed through a hole in the mirror surface 28. These means for illumination may also be used for erasing the photochromic image when desired. Other means for illuminating the target by light will be evident to those familar with the art.

We claim:

1. A projection cathode ray tube comprising the combination of a sealed evacuated envelope comprising a tubular portion, a mirror portion sealed to one end of the tubular portion, the mirror portion having an inner concave mirror surface with a first aperture therein, an electron gun container portion sealed to the first aperture, a transparent face plate sealed to the other end of the tubular portion, the face plate having a second aperture therein, and a bellows having one end sealed to the second aperture and being closed at the other end thereof, a target member within the envelope, attached to said other end of the bellows and having a surface with an electron beam sensitive coating thereon, an electron gun within said electron gun container portion in position to direct a beam of electrons on to said coating, said mirror surface being located to reflect light between said coating and said face plate, and means to adjust the target member position relative to the mirror portion including a shaft portion extending through the bellows and having an axis adjustably rotatable relative to said face plate, one end of the shaft portion being engaged with the target member and adapted to impart movements thereto longitudinally of the shaft portion and rotatably relative to said faceplate, a frame portion extending laterally from the other end of the shaft portion exteriorly of the envelope and having reference surface thereon each in engagement with the face plate, and means on the frame portion for independently adjusting the displacement between each of said reference surfaces and the target member.

2. a tube according to claim 1, in which the means for adjustably rotating the shaft axis comprise a plurality of support legs adjustably threaded into the frame portion.

3. A tube according to claim 1, in which the shaft portion is fixed in relation to the target member.

4. A tube according to claim 3, in which the shaft portion is axially movable in relation to the frame portion.

5. A tube according to claim 1, in which said reference surfaces bear with pressure upon surfaces fixed in relation to the face plate, said pressure being produced by means resiliently urging the target member in a direction to vary the longitudinal extent of the bellows.

6. A tube according to claim 5, in which the shaft portion is slidable in the frame portion and has a stop nut adjustably threaded thereon and resiliently bearing on the frame portion.

7. A tube according to claim 5, in which said means urging the target member is a coil spring.

8. A tube according to claim 1, in which the electron beam sensitive coating generates visible light upon impingement by an electron beam.

9. A tube according to claim 1, in which the electron beam sensitive coating is a dark trace material, and including means to project visible light upon said coating.

10. A tube according to claim 1, wherein said shaft and frame portions are of thermally conductive material and comprise a heat flow path from the beam sensitive coating to the outside of the tube envelope.

* * * * *